US011522300B2

(12) United States Patent
Borrelli et al.

(10) Patent No.: US 11,522,300 B2
(45) Date of Patent: Dec. 6, 2022

(54) INTEGRAL 5G ANTENNA STRUCTURE

(71) Applicant: CORNING INCORPORATED, Corning, NY (US)

(72) Inventors: Nicholas Francis Borrelli, Elmira, NY (US); Allegra Josephine Dawes, Corning, NY (US); Joseph Francis Schroeder, III, Lindley, NY (US); Dean Michael Thelen, Addison, NY (US)

(73) Assignee: Corning Incorporated, Corning, NY (US)

( * ) Notice: Subject to any disclaimer, the term of this patent is extended or adjusted under 35 U.S.C. 154(b) by 25 days.

(21) Appl. No.: 16/912,793

(22) Filed: Jun. 26, 2020

(65) Prior Publication Data

US 2020/0412019 A1 Dec. 31, 2020

Related U.S. Application Data

(60) Provisional application No. 62/868,454, filed on Jun. 28, 2019.

(51) Int. Cl.

| | |
|---|---|
| ***H01Q 21/06*** | (2006.01) |
| ***H01Q 1/38*** | (2006.01) |
| ***H01Q 5/47*** | (2015.01) |
| ***H01Q 9/04*** | (2006.01) |

(52) U.S. Cl.

CPC ..... *H01Q 21/065* (2013.01); *H01Q 1/38* (2013.01); *H01Q 5/47* (2015.01); *H01Q 9/0407* (2013.01)

(58) Field of Classification Search

CPC ..... H01Q 21/065; H01Q 1/38; H01Q 5/47; H01Q 9/0407; H01Q 3/34; H01Q 9/0457; H01Q 21/0087

See application file for complete search history.

(56) References Cited

U.S. PATENT DOCUMENTS

| | | | | |
|---|---|---|---|---|
| 8,260,203 | B2 | 9/2012 | Brantner | |
| 9,487,441 | B2 | 11/2016 | Borrelli et al. | |
| 10,116,035 | B2 | 10/2018 | Borrelli et al. | |
| 2003/0142018 | A1* | 7/2003 | Lange | H01Q 15/0013 343/897 |

(Continued)

OTHER PUBLICATIONS

Mohr et al., "Formation Of Silver Particles And Periodic Precipitate Layers In Silicate Glass Induced By Thermally Assisted Hydrogen Permeation", J. Phys.: Condens. Matter 13, 2001, pp. 525-536.

(Continued)

*Primary Examiner* — David E Lotter

(74) *Attorney, Agent, or Firm* — Svetlana Short

(57) ABSTRACT

Embodiments of the disclosure relate to an antenna device. The antenna device includes a glass sheet having a first major surface and a second major surface opposite to the first major surface. The first major surface and the second major surface define a thickness of the glass sheet. The antenna device also includes at least one patch antenna. Each of the at least one patch antenna includes a first metallic layer that is located within the thickness of the glass sheet at or below the first major surface. Additionally, the antenna device includes a ground plane comprising a second metallic layer that is located within the thickness of the glass sheet at or below the second major surface.

20 Claims, 4 Drawing Sheets

(56) References Cited

U.S. PATENT DOCUMENTS

| | | | | |
|---|---|---|---|---|
| 2007/0216589 | A1* | 9/2007 | Li | H01Q 1/1271 343/711 |
| 2015/0084814 | A1* | 3/2015 | Rojanski | H01Q 9/0414 342/368 |
| 2015/0246847 | A1 | 9/2015 | Wackerow et al. | |
| 2016/0261039 | A1* | 9/2016 | Parsche | H01Q 9/0407 |
| 2020/0176859 | A1* | 6/2020 | Furlan | H01Q 1/1271 |

OTHER PUBLICATIONS

Nabika et al., "Liesegang Patterns Engineered by a Chemical Reaction Assisted by Complex Formation", ACS Publication, Langmuir 2014, 30, pp. 5047-5051.

Pask et al., "Study of Diffusion in Glass", Journal of the American Ceramic Society, vol. 26, No. 8, Jun. 2006, pp. 267-277.

* cited by examiner

INTEGRAL 5G ANTENNA STRUCTURE

CROSS-REFERENCE TO RELATED APPLICATIONS

This application claims the benefit of priority of U.S. Application No. 62/868,454 filed on Jun. 28, 2019 the contents of which are relied upon and incorporated herein by reference in their entirety as if fully set forth below.

BACKGROUND

The disclosure relates generally to an antenna structure and, in particular, to an antenna structure having patch antennas disposed within a glass sheet. Deployment of the 5G network has required the installation of many new antennas. In particular, various new antennas will be needed to relay signals within the network and to receive/transmit signals at user devices.

SUMMARY

In one aspect, embodiments of the disclosure relate to an antenna device. The antenna device includes a glass sheet having a first major surface and a second major surface opposite to the first major surface. The first major surface and the second major surface define a thickness of the glass sheet. The antenna device also includes at least one patch antenna. Each of the at least one patch antenna includes a first metallic layer that is located within the thickness of the glass sheet at or below the first major surface. Additionally, the antenna device includes a ground plane comprising a second metallic layer that is located within the thickness of the glass sheet at or below the second major surface.

In another aspect, embodiments of the disclosure relate to a method. In the method, a pattern for an array of patch antennas is created on a first major surface of a glass sheet. The pattern has first regions where the patch antennas are to be formed. An ion exchange reaction is performed so that metal ions diffuse into the first major surface of the glass sheet in the first regions and into a second major surface of the glass sheet opposite to the first major surface. Further, the glass sheet is exposed to a reducing atmosphere and a temperature of 250° C. to 600° C. to cause the metal ions to precipitate into layers in the first regions. The metal layers include the patch antennas and a ground plane. The patch antennas are formed at or below the first metal surface, and the ground plane is formed at or below the second major surface.

In still another aspect, embodiments of the disclosure relate to an antenna device. The antenna device includes a glass sheet having a first major surface and a second major surface opposite to the first major surface. The first major surface and the second major surface define a thickness of the glass sheet. The antenna device also includes a plurality of patch antennas arranged into one or more phased arrays. Each of the plurality of patch antennas includes a first metallic layer having silver that is located within the thickness of the glass sheet at a distance of up to 50 μm from the first major surface. Further, the antenna device includes a ground plane having a second metallic layer with silver that is located within the thickness of the glass sheet at a distance of up to 50 μm from the second major surface. Additionally, the antenna device includes a coaxial cable comprising a conductor wire surrounded by a dielectric layer in which the dielectric layer is surrounded by a ground sheath. The conductor wire is configured to transmit a signal having a frequency in the range of 20 GHz to 100 GHz to the plurality of patch antennas, and the ground sheath is electrically connected to the ground plane.

Additional features and advantages will be set forth in the detailed description that follows, and, in part, will be readily apparent to those skilled in the art from the description or recognized by practicing the embodiments as described in the written description and claims hereof, as well as the appended drawings.

It is to be understood that both the foregoing general description and the following detailed description are merely exemplary, and are intended to provide an overview or framework to understand the nature and character of the claims.

BRIEF DESCRIPTION OF THE DRAWINGS

The accompanying drawings are included to provide a further understanding and are incorporated in and constitute a part of this specification. The drawings illustrate one or more embodiment(s), and together with the description serve to explain principles and the operation of the various embodiments. In the drawings.

DETAILED DESCRIPTION

Embodiments of the present disclosure relate to an antenna device. The antenna device includes one or more patch antennas formed within a glass sheet. That is, the patch antennas are a layer of metal located at or below the surface of glass that are formed via the Liesegang phenomenon. As will be discussed below, metal ions are diffused into a glass sheet, and the glass sheet is then heat treated in a reducing atmosphere, causing the metal to precipitate in a layer beneath the glass surface. The precipitated metal layers act as patch antennas when exposed to radio frequency radiation.

Advantageously, the antenna devices are integral components that do not require multiple separate components and connections. That is, the antenna devices can be manufactured in relatively few steps and in a manner that contributes to the robustness of the antenna device. In particular, forming the metal layers within the glass sheets avoids the difficulties of bonding metal to glass and the possibility of the metal layer being scratched off the surface of the glass sheet. These and other aspects and advantages of the antenna device will be discussed in relation to the various embodiments provided herein. These embodiments are presented by way of example only and not by way of limitation.

Figure 1:
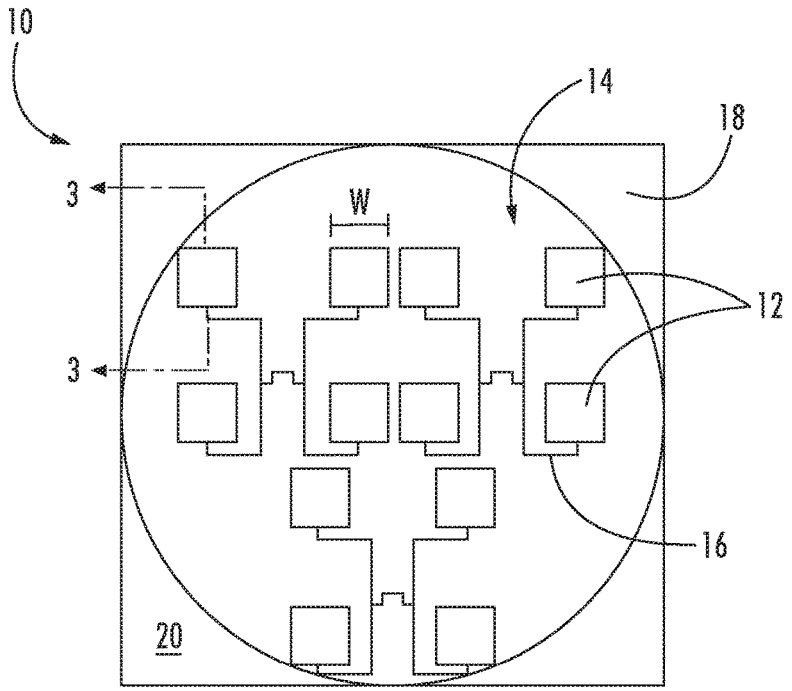
FIG. 1 depicts a plan view of an antenna device, according to an exemplary embodiment.

FIG. 1 depicts an embodiment of the antenna device 10 according to the present disclosure. The antenna device 10 includes one or more patch antennas 12 arranged in an array 14. The patch antennas 12 each are comprised of a rectangular sheet (i.e., "patch") of metal material that, in the construction disclosed herein, are configured to transmit and receive electromagnetic radiation. Advantageously, arrangement of the patch antennas 12 into arrays 14 allows, through interference patterns, the antenna device 10 to be electronically directed and aimed. The patch antennas 12 in the array 14 are connected by traces 16. The patch antennas 12 and traces 16 are formed in a glass sheet 18. In embodiments, the patch antennas 12 and traces 16 are formed below a first major surface 20 of the glass sheet 18. In embodiments, the patch antennas 12 are specifically configured to transmit and/or receive electromagnetic radiation having a frequency in the range of 20 GHz to 100 GHz (particularly, in the range of 28 GHz to 60 GHz, which is characteristic of 5G cellular data transmission). Thus, a width w of the patch antennas 12 is sized to be half the wavelength of the signal transmitted/received by the patch antennas 12. In embodiments, the patch antennas 12 have a width of from 0.1 mm to 10 mm, more particularly from 2.5 mm to 7.5 mm.

Figure 2:
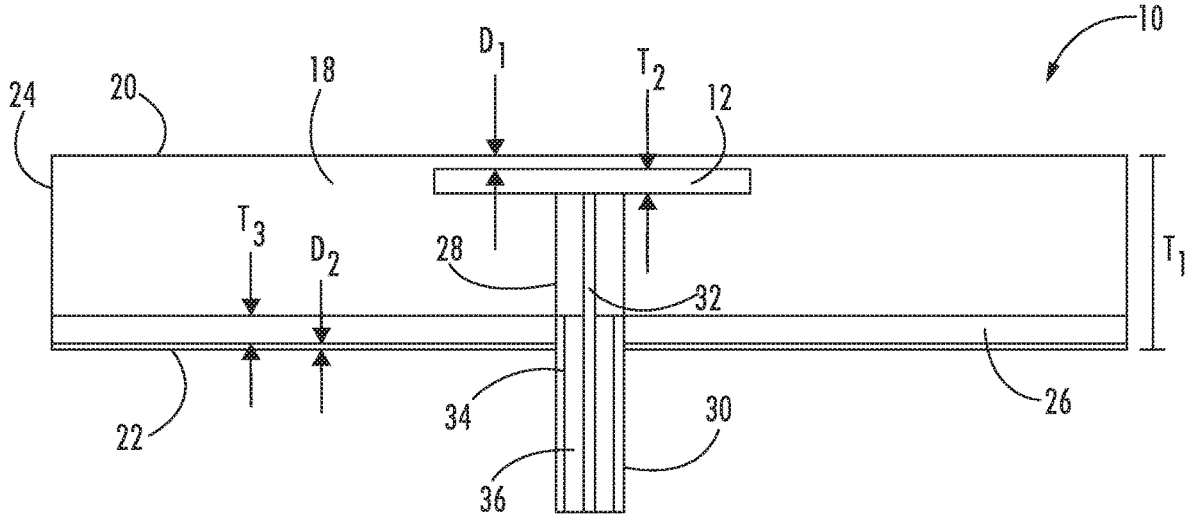
FIG. 2 depicts a cross-sectional view of the antenna device of FIG. 1, according to an exemplary embodiment.

FIG. 2 depicts a cross-sectional view of the antenna device 10 of FIG. 1. As can be seen in FIG. 2, the glass sheet 18 has a second major surface 22 opposite to the first major surface 20 and a minor surface 24 joining the first major surface 20 and the second major surface 22. The first major surface 22 and the second major surface 22 define a thickness $T_1$ of the glass sheet 18. In embodiments, the thickness $T_1$ is on average from 0.1 mm to 4 mm. In other embodiments, the thickness $T_1$ is on average from 0.5 mm to 3 mm, and in still other embodiments, the thickness $T_1$ is on average from 1 mm to 2 mm. In embodiments, the glass sheet 18 comprises at least one of silicate glass, soda lime silicate glass, aluminosilicate glass, borosilicate glass, alkali aluminosilicate, or alkaline earth boro-aluminosilicate. Further, in embodiments, the glass sheet 18 may be strengthened, such as chemically strengthened, to produce surface compressive stresses.

Disposed at or below the second major surface 24 is a ground plane 26. In embodiments, the patch antennas 12 and ground plane 26 are layers of metal that have diffused into the glass sheet 12 and then precipitated into layers. In embodiments, the patch antennas 12 and the ground plane 26 are made from silver. Further, in embodiments, the metal layers making up the patch antennas 12 have an electrical resistivity of 50 nΩ·m to about 2000 nΩ·m.

In embodiments, the patch antennas 12 each have a thickness $T_2$, on average, of from 0.01 μm to 3 μm. In other embodiments, the thickness $T_2$ is on average from 0.1 μm to 1 μm, and in still other embodiments, the thickness $T_2$ is on average from 0.3 μm to 0.7 μm. In embodiments, the ground plane 26 has a thickness $T_3$, on average, of from 0.01 μm to 3 μm. In other embodiments, the thickness $T_3$ is on average from 0.1 μm to 1 μm, and in still other embodiments, the thickness $T_3$ is on average from 0.3 μm to 0.7 μm.

In embodiments, the patch antennas 12 are at a depth $D_1$ of up to 1 μm below the first major surface 20. That is, the patch antenna 12 may begin at the first major surface 20 or at a depth $D_1$ of up to 1 μm below the first major surface 20. In other embodiments, the patch antennas 12 are at a depth $D_1$ of up to 5 μm below the first major surface 20, and in still other embodiments, the patch antennas 12 are at a depth $D_1$ of up to 10 μm below the first major surface 20. In embodiments, the ground plane 26 are at a depth $D_2$ of up to 1 μm below the second major surface 22. That is, the ground plane 26 may begin at the second major surface 22 or at a depth $D_2$ of up to 1 μm below the second major surface 22. In other embodiments, the ground plane 26 is at a depth $D_2$ of up to 5 μm below the second major surface 22, and in still other embodiments, the ground plane 26 is at a depth $D_2$ of up to 10 μm below the second major surface 22. Further, in embodiments, the patch antennas 12 and/or ground plane 26 may have a surface that is level with the respective first and/or second major surface 20, 22.

In embodiments, the glass sheet 18 includes at least one hole 28 that extends from the second major surface 22 to or near patch antenna 12 (or traces 16 as shown in FIG. 1). The hole 28 allows for electrical connection to be made to the patch antennas 12. In embodiments, a coaxial cable 30 carries electromagnetic radiation to the patch antennas 12. In particular, the hole 28 allows for a conductor (e.g., wire, conductive coupling, metalized link, cable), such as conductor 32 of the coaxial cable 30, to transmit electromagnetic radiation to the patch antennas 12. Further, in embodiments, the coaxial cable 30 has a ground sheath 34 that is separated from the conductor 32 by a dielectric layer 36. The ground sheath 34 is electrically connected to the ground plane 26.

Figure 3:
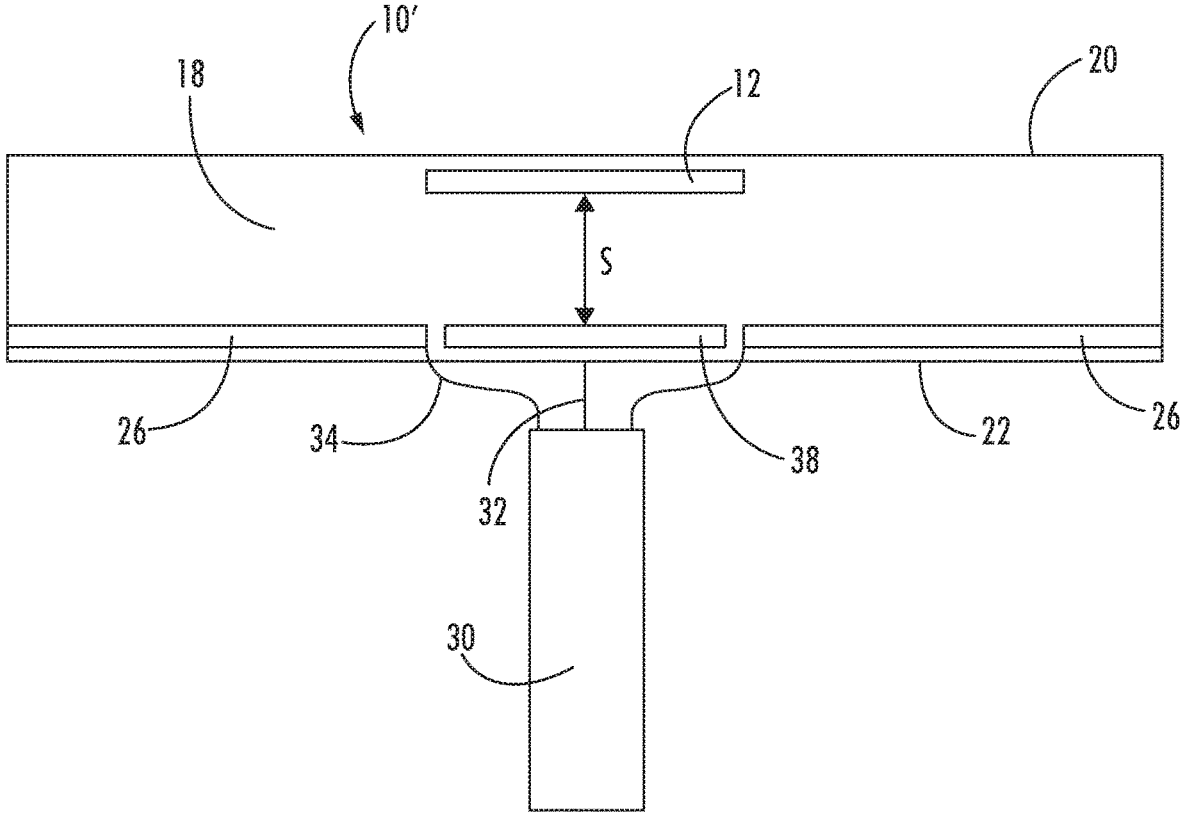
FIG. 3 depicts a cross-sectional view of another antenna device, according to an exemplary embodiment.

FIG. 3 depicts another embodiment of an antenna device 10' that is substantially similar to the antenna device 10 of FIG. 2 with the exception that there is no hole 28 to provide a physical connection to the patch antenna 12. Instead, in the embodiment of FIG. 3, the conductor 32 of the coaxial cable 30 is attached to a strip 38 that forms a capacitive connection with the patch antenna 12. As can be seen in FIG. 3, the ground sheath 34 is electrically connected with the ground plane 26, and electromagnetic radiation transmitted along the conductor 32 of the coaxial cable 30 are communicated to the strip 38. The patch antenna 12 and the strip 38 are separated by a spacing s, and the glass sheet 18 acts as a dielectric layer between the strip 38 and the patch antenna 12. In embodiments, the spacing s is from 0.1 mm to 2 mm, more particularly from 0.4 mm to 1 mm. In a particular embodiment, the spacing s is a multiple of the wavelength of the transmitted/received electromagnetic radiation. Because the frequency of the signal is a relative high frequency AC signal and because the spacing s is sufficiently small, the electromagnetic radiation will be electromagnetically coupled to the patch antenna 12, allowing the patch antenna 12 to transmit the signal carried by the coaxial cable 30.

Figure 4:
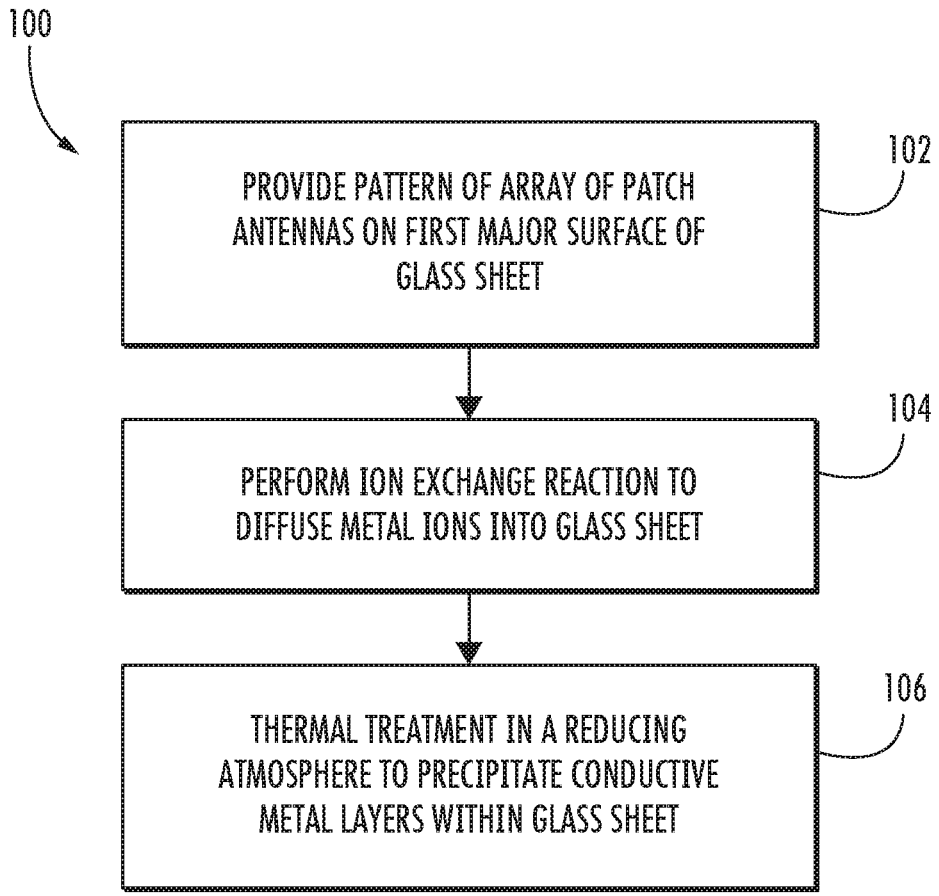
FIG. 4 depicts a flow diagram of a method of fabricating the antenna devices, according to an exemplary embodiment.

Having described the structure of the antenna device 10, 10', attention is now turned to methods of producing the antenna device 10, 10'. FIG. 4 depicts a flow diagram of a method 100 of producing the antenna device 10' of FIG. 3.

In a first step 102, a pattern defining the array 14 of patch antennas 12 and traces 16 is formed on the first major surface 20 of the glass sheet. In embodiments, the pattern is a negative, i.e., the pattern leaves regions where the patch antennas 12 and traces 16 are to be formed open and covers the surrounding regions. In other embodiments, the pattern is a positive, i.e., a material is deposited in regions were the patch antennas 12 and traces 16 are to be formed. Regarding the formation of a negative pattern, the first major surface 20 of the glass sheet 18 may masked with a masking layer except for regions where the patch antennas 12 and traces 16 are to be formed. In embodiments, the masking layer comprises, for example, SiC. Further, in embodiments, the masking layer can be applied through any of a variety of techniques, such as photolithographic deposition. Regarding the formation of a positive pattern, the coating may be a paste comprising silver or a silver compound that is screen-printed onto the first major surface 20 of the glass sheet 18. Alternatively, the coating may be a thin film comprising silver or a silver compound which is deposited on the glass sheet 18 by sputtering, vacuum deposition, or another similar technique.

In a second step 104, the metal, particularly silver, that forms the patch antennas 12, traces 16, and ground plane 26 is introduced in the glass sheet 18 through an ion exchange treatment. In one embodiment, silver ions are introduced in the glass sheet 18 by positioning the glass sheet 18 having the negatively-patterned mask layer in a molten salt bath containing silver ions to facilitate the exchange of the silver ions in the salt bath with ions in the glass sheet 18, such as sodium and/or lithium ions. In the embodiment involving a positively-patterned coating, silver ions are introduced in the glass sheet 18 through the coating containing silver to first and/or second major surfaces 20, 22 of the glass sheet 18 and heating the glass sheet 18 with the coating to promote the exchange of silver ions in the coating with ions in the glass sheet 18, such as sodium and/or lithium ions.

More specifically, in one embodiment, silver ions are introduced in the glass sheet 18 through an ion exchange process which is performed in a bath of molten salt. The salt bath generally contains a silver salt, such as $AgNO_3$, AgCl or the like, in addition to an alkali salt. For example, in one embodiment the molten salt bath comprises from about 0.5 wt. % to about 5 wt. % of a silver salt, such as $AgNO_3$ or the like, and from about 95 wt. % to about 99.5 wt. % of $MNO_3$, wherein M is an alkali metal ion such as such as, for example, potassium, sodium, rubidium, and/or cesium ions. In the embodiments described herein, M is either potassium or sodium. However, it should be understood that other alkali metal ions may be used in the salt bath which contains silver.

The salt bath containing silver ions is maintained at a bath temperature from about 300° C. to about 500° C. to facilitate the ion exchange process. In some embodiments, the bath temperature may be from about 300° C. to less than or equal to about 450° C. to facilitate the ion exchange process. The glass sheet 18 is held in the salt bath containing silver ions for an ion exchange period which is greater than or equal to about 5 minutes and less than or equal to 1 hour in order to achieve the desired concentration of silver ions in the body of the glass sheet 18. In some embodiments the ion exchange period may be less than or equal to 0.5 hours or even less than or equal to 0.25 hours. The temperature of the salt bath containing silver ions and the ion exchange period may be adjusted to obtain the desired concentration of silver ions. Following the ion exchange process, the glass article may be substantially clear or have a slightly yellow tint as a result of the presence of the silver ions in the glass substrate.

Following the ion-exchange step 104, the glass sheet 18 undergoes a step 106 of thermal treatment performed in a reducing atmosphere. In particular, the glass sheet 18 is removed from the bath and positioned in a reducing atmosphere, such as flowing hydrogen gas, and simultaneously heated to promote the precipitation and growth of metallic layers in the body of the glass sheet 18 which subsequently creates the metallic layers in the glass sheet 18 that function as patch antennas 12 and the grounding plane 26. The combination of the ion exchange time in the salt bath containing silver ions and the treatment time in the reducing atmosphere dictate the number of layers formed in the glass substrate.

For example, the glass sheet 18 may be positioned in a tube furnace through which hydrogen gas is flowing. The glass sheet 18 is then heated to a reducing temperature which is from about 250° C. to about 600° C. and held at this temperature for a treatment period which is from 5 minutes to 50 hours. In embodiments where the glass sheet 18 is a strengthened glass sheet that includes a layer of compressive stress, the reducing temperature is no more than 300° C. to minimize the relaxation of the compressive stress. The reaction of hydrogen and silver ions results in an uncharged silver atom ($Ag^0$), which is a nucleation reaction. That is, silver layers nucleate from the interaction of silver ions and hydrogen.

Figure 5:
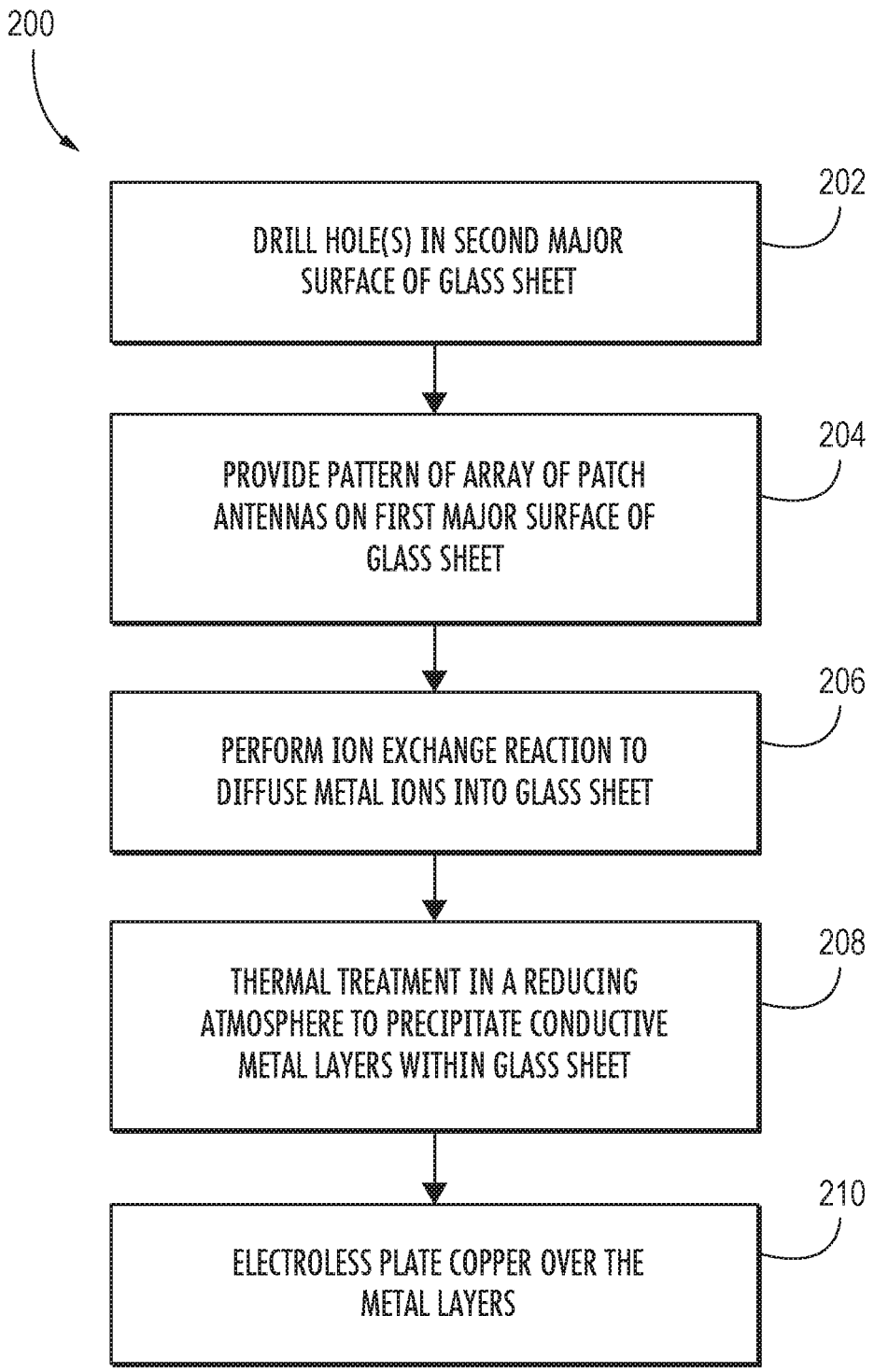
FIG. 5 depicts flow diagram of a method of fabricating the antenna devices, according to another exemplary embodiment.

FIG. 5 depicts another embodiment of a method for forming the antenna device 10 of FIG. 2. In a first step 202, a hole 28 is drilled into the second major surface 22 of the glass sheet 18 to allow a conductor 32 of a coaxial cable to electrically contact a patch antenna 12. In a second step 204, a pattern defining the array 14 of patch antennas 12 and traces 16 is formed on the first major surface 20 of the glass sheet. As with the previously described method, the pattern may be a negative or a positive formed through one of the techniques described above with respect to step 102 of FIG. 4. In a third step 206, the metal, particularly silver, that forms the patch antennas 12, traces 16, and ground plane 26 is introduced in the glass sheet 18 through an ion exchange treatment as described above with respect to step 104 of FIG. 4. Following the ion-exchange step 206, the glass sheet 18 undergoes a step 208 of thermal treatment performed in a reducing atmosphere. In particular, the glass sheet 18 is removed from the bath and positioned in a reducing atmosphere, such as flowing hydrogen gas, and simultaneously heated to promote the precipitation and growth of metallic layers in the body of the glass sheet 18 which subsequently creates the metallic layers in the glass sheet 18 that function as patch antennas 12 and the grounding plane 26. Further, in embodiments, the method may also comprise a step 210 in which copper is deposited over the patch antennas 12 and/or the ground plane 26. In particular, electroless plating is used in embodiments to deposit copper on the first and/or second major surfaces 20, 22 over the silver layers forming the patch antennas 12 and/or ground plane 26 to increase the conductivity of these elements.

Using the embodiments of the methods disclosed herein, a patch antenna can be fabricated in which the patterned conductive phase array, grounding plane, internal connectors, and dielectric substrate are integrated in a single piece of glass. In this way, the multiple parts of a patch antenna are condensed into a single structure requiring only a coaxial cable connection to complete the array. In a single process, all these components of the patch antenna are created. Complete antennas can be printed onto wafers without any further fabrication steps required beyond connecting coaxial cables. Further, this structure and method of fabrication provides an easy way for phase arrays that enable the directional control of the antenna to be patterned.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more than one component or element, and is not intended to be construed as meaning only one.

It will be apparent to those skilled in the art that various modifications and variations can be made without departing from the spirit or scope of the disclosed embodiments. Since modifications, combinations, sub-combinations and variations of the disclosed embodiments incorporating the spirit and substance of the embodiments may occur to persons skilled in the art, the disclosed embodiments should be construed to include everything within the scope of the appended claims and their equivalents.

What is claimed is:

1. An antenna device, comprising:

a glass sheet having a first major surface and a second major surface opposite to the first major surface, the first major surface and the second major surface defining a thickness of the glass sheet;

at least one patch antenna, each of the at least one patch antenna comprising a first metallic layer that is located within the thickness of the glass sheet at or below the first major surface;

a ground plane comprising a second metallic layer that is located within the thickness of the glass sheet at or below the second major surface; and a hole extending from the second major surface of the glass sheet towards one of the at least one patch antenna, wherein a conductor extends into the hole for electrical connection to the at least one patch antenna.

2. The antenna device of claim 1, wherein each of the first metallic layer comprises silver, and wherein the second metallic layer comprises silver.

3. The antenna device of claim 2, wherein the at least one patch antenna comprises a plurality of patch antennas arranged in one or more phased arrays.

4. The antenna device of claim 3, wherein the thickness of the glass sheet is on average from 0.1 mm to 4 mm.

5. The antenna device of claim 4, wherein the glass sheet comprises at least one of silicate glass, soda lime silicate glass, aluminosilicate glass, borosilicate glass, alkali aluminosilicate, or alkaline earth boro-aluminosilicate.

6. The antenna device of claim 5, wherein each of the first metallic layer has a thickness of from 0.01 μm to 3 μm, wherein the second metallic layer has a thickness of from 0.01 μm to 3 μm.

7. The antenna device of claim 6, wherein each of the first metallic layer has an electrical resistivity of 50 nΩ·m to 2000 nΩ·m, wherein the second metallic layer has an electrical resistivity of 50 nΩ·m to 2000 nΩ·m.

8. The antenna device of claim 7, wherein each of the at least one patch antenna is configured to transmit and/or receive radiation having a frequency of 20 GHz to 100 GHz.

9. The antenna device of claim 8, further comprising a coaxial cable, and wherein the conductor is or is coupled to a conductor of the coaxial cable, wherein the coaxial cable further comprises a ground sheath.

10. The antenna device of claim 9, wherein the conductor of the coaxial cable is inserted into the hole, wherein the ground sheath is electrically connected to the ground plane.

11. The antenna device of claim 1, further comprising copper plated over one or more of the at least one patch antenna, the ground plane, or both.

12. An antenna device, comprising:

a glass sheet having a first major surface and a second major surface opposite to the first major surface, the first major surface and the second major surface defining a thickness of the glass sheet;

a plurality of patch antennas arranged into one or more phased arrays, each of the plurality of patch antennas comprising a first metallic layer comprising silver that is located within the thickness of the glass sheet at a distance of up to 10 μm from the first major surface;

a ground plane comprising a second metallic layer comprising silver that is located within the thickness of the glass sheet at a distance of up to 10 μm from the second major surface; and a coaxial cable comprising a conductor wire surrounded by a dielectric layer, the dielectric layer being surrounded by a ground sheath;

wherein the conductor wire is configured to transmit a signal having a frequency in a range of 20 GHz to 100 GHz to the plurality of patch antennas; and wherein the ground sheath is electrically connected to the ground plane.

13. The antenna device according to claim 12, further comprising a hole extending from the second major surface of the glass sheet towards one of the plurality of patch antennas, wherein the conductor wire of the coaxial cable is inserted into the hole.

14. The antenna device according to claim 12, further comprising a strip disposed on the second major surface of the glass sheet, wherein the conductor wire is electrically connected to the strip and wherein the strip is capacitively coupled to the plurality of patch antennas.

15. An antenna device, comprising:

a glass sheet having a first major surface and a second major surface opposite to the first major surface, the first major surface and the second major surface defining a thickness of the glass sheet;

at least one patch antenna, each of the at least one patch antenna comprising a first metallic layer that is located within the thickness of the glass sheet at or below the first major surface;

a ground plane comprising a second metallic layer that is located within the thickness of the glass sheet at or below the second major surface; and a strip disposed on the second major surface of the glass sheet, wherein the strip is capacitively coupled to the at least one patch antenna.

16. The antenna device of claim 15, wherein a spacing between the strip and the at least one patch antenna is from 0.1 mm to 2 mm.

17. The antenna device of claim 15, further comprising a coaxial cable comprising a conductor, wherein the conductor is electrically connected to the strip.

18. The antenna of device of claim 17, wherein the coaxial cable further comprises a ground sheath and a dielectric layer separating the conductor and the ground sheath and wherein the ground sheet is electrically connected to the ground plane.

19. The antenna device of claim 15, wherein each of the at least one patch antenna is configured to transmit and/or receive radiation having a frequency of 20 GHz to 100 GHz.

20. The antenna device of claim 15, wherein the thickness of the glass sheet is on average from 0.1 mm to 4 mm.

* * * * *